US008382246B2

(12) United States Patent
Silverbrook et al.

(10) Patent No.: US 8,382,246 B2
(45) Date of Patent: Feb. 26, 2013

(54) PRINTHEAD HAVING MIRRORED ROWS OF PRINT NOZZLES

(75) Inventors: Kia Silverbrook, Balmain (AU); Mark Jackson Pulver, Balmain (AU); Michael John Webb, Balmain (AU); John Robert Sheahan, Balmain (AU); Simon Robert Walmsley, Balmain (AU)

(73) Assignee: Zamtec Ltd, Dublin (IE)

( * ) Notice: Subject to any disclaimer, the term of this patent is extended or adjusted under 35 U.S.C. 154(b) by 0 days.

(21) Appl. No.: 13/330,348

(22) Filed: Dec. 19, 2011

(65) Prior Publication Data

US 2012/0086748 A1 Apr. 12, 2012

Related U.S. Application Data

(63) Continuation of application No. 12/972,512, filed on Dec. 19, 2010, now Pat. No. 8,079,663, which is a continuation of application No. 11/650,537, filed on Jan. 8, 2007, now Pat. No. 7,866,791, which is a continuation of application No. 10/922,845, filed on Aug. 23, 2004, now Pat. No. 7,182,422.

(51) Int. Cl.

| | |
|---|---|
| ***B41J 2/15*** | (2006.01) |
| ***B41J 2/145*** | (2006.01) |
| ***B41J 2/14*** | (2006.01) |
| ***B41J 2/16*** | (2006.01) |
| ***B41J 2/05*** | (2006.01) |
| ***B41J 29/38*** | (2006.01) |

(52) U.S. Cl. ..... 347/40; 347/47; 347/63; 347/12; 347/13

(58) Field of Classification Search ..... None
See application file for complete search history.

(56) References Cited

U.S. PATENT DOCUMENTS

| | | | |
|---|---|---|---|
| 4,999,650 | A | 3/1991 | Braun |
| 5,043,740 | A | 8/1991 | Kneezel et al. |
| 5,160,403 | A | 11/1992 | Fisher et al. |
| 5,221,397 | A | 6/1993 | Nystrom |
| 5,363,134 | A | 11/1994 | Barbehenn et al. |
| 5,755,024 | A | 5/1998 | Drake et al. |
| 5,796,416 | A | 8/1998 | Silverbrook |
| 5,815,173 | A | 9/1998 | Silverbrook |
| 6,062,666 | A | 5/2000 | Omata et al. |
| 6,123,410 | A | 9/2000 | Beerling et al. |
| 6,234,598 | B1 | 5/2001 | Torgerson et al. |
| 6,247,788 | B1 | 6/2001 | Kamei |
| 6,318,849 | B1 | 11/2001 | Silverbrook |
| 6,350,004 | B1 | 2/2002 | Askren |
| 6,382,773 | B1 | 5/2002 | Chang et al. |
| 6,443,555 | B1 | 9/2002 | Silverbrook et al. |
| 6,464,341 | B1 | 10/2002 | Furlani et al. |
| 6,478,396 | B1 | 11/2002 | Schloeman et al. |
| 7,182,422 | B2 | 2/2007 | Silverbrook et al. |
| 7,195,328 | B2 | 3/2007 | Silverbrook et al. |
| 2001/0020960 | A1 | 9/2001 | Ikemoto et al. |
| 2002/0093544 | A1 | 7/2002 | Schloeman et al. |
| 2002/0180833 | A1 | 12/2002 | Castano et al. |

(Continued)

FOREIGN PATENT DOCUMENTS

| | | | |
|---|---|---|---|
| EP | 1080903 | A2 | 3/2001 |
| EP | 1172212 | A | 1/2002 |

(Continued)

*Primary Examiner* — Stephen Meier
*Assistant Examiner* — Leonard S Liang
(74) *Attorney, Agent, or Firm* — Cooley LLP

(57) ABSTRACT

A printhead having at least first and second rows of print nozzle cells. Each each nozzle cell has an ink chamber, control circuitry and drive circuitry. Each nozzle cell in the first row has a corresponding nozzle cell in the second row. The drive circuitry of each nozzle cell of the first row is arranged adjacent the drive circuitry of the corresponding nozzle cell in the second row and distant the control circuitry of the corresponding nozzle cell in the first row.

13 Claims, 4 Drawing Sheets

U.S. PATENT DOCUMENTS

| | | | |
|---|---|---|---|
| 2003/0174189 | A1 | 9/2003 | Wang |
| 2003/0184614 | A1 | 10/2003 | Torgerson et al. |
| 2004/0012654 | A1 | 1/2004 | Takeuchi et al. |
| 2004/0160479 | A1 | 8/2004 | Huang |
| 2004/0183843 | A1 | 9/2004 | Walmsley et al. |
| 2004/0257400 | A1 | 12/2004 | Silverbrook |
| 2005/0219299 | A1 | 10/2005 | Silverbrook et al. |
| 2005/0231543 | A1 | 10/2005 | Hosono |
| 2006/0038841 | A1 | 2/2006 | Silverbrook et al. |
| 2006/0092205 | A1 | 5/2006 | Jackson Pulver et al. |

FOREIGN PATENT DOCUMENTS

| | | |
|---|---|---|
| JP | 09-164686 | 6/1997 |
| JP | 2001199074 A | 7/2001 |

PRINTHEAD HAVING MIRRORED ROWS OF PRINT NOZZLES

CROSS REFERENCE TO RELATED APPLICATION

The present application is a continuation of U.S. application Ser. No. 12/972,512 filed on Dec. 19, 2010, now issued U.S. Pat. No. 8,079,663, which is a continuation of U.S. application Ser. No. 11/650,537 filed on Jan. 8, 2007, now issued as U.S. Pat. No. 7,866,791 which is a continuation of U.S. application Ser. No. 10/922,845 filed on Aug. 23, 2004, now issued U.S. Pat. No. 7,182,422, all of which are herein incorporated by reference in their entirety for all purposes.

FIELD OF INVENTION

The present invention relates to the field of printheads.

The invention has primarily been developed for use with applicant's inkjet printhead comprising a plurality of printhead modules extending across a pagewidth, and will be described with reference to this application. However, it will be appreciated that the invention can be applied to other printhead arrangements having multiple rows of print nozzles.

CROSS REFERENCES

Various methods, systems and apparatus relating to the present invention are disclosed in the following granted U.S. patents and co-pending U.S. applications filed by the applicant or assignee of the present application: The disclosures of all of these granted U.S. patents and co-pending U.S. applications are incorporated herein by reference.

| | | | | | |
|---|---|---|---|---|---|
| 7,249,108 | 6,566,858 | 6,331,946 | 6,246,970 | 6,442,525 | 7,346,586 |
| 7,685,423 | 6,374,354 | 7,246,098 | 6,816,968 | 6,757,832 | 6,334,190 |
| 6,745,331 | 7,249,109 | 7,197,642 | 7,093,139 | 7,509,292 | 7,685,424 |
| 7,743,262 | 7,210,038 | 7,165,824 | 7,416,280 | 7,252,366 | 7,488,051 |
| 7,360,865 | 7,275,811 | 7,278,034 | 7,152,942 | 7,818,519 | 7,377,608 |
| 7,399,043 | 7,121,639 | 7,770,008 | 7,188,282 | 7,592,829 | 7,181,572 |
| 7,096,137 | 7,302,592 | 7,831,827 | 7,707,621 | 7,523,111 | 7,573,301 |
| 7,660,998 | 7,783,886 | 6,977,751 | 6,398,332 | 6,394,573 | 6,795,215 |
| 7,154,638 | 6,859,289 | 7,328,956 | 7,374,266 | 7,427,117 | 6,622,923 |
| 6,747,760 | 6,921,144 | 8,011,747 | 7,735,944 | 7,188,928 | 7,448,707 |
| 7,281,330 | 7,600,843 | 7,275,805 | 7,252,353 | 7,390,071 | 7,093,989 |
| 7,377,609 | 7,549,715 | 7,758,143 | 7,314,261 | 7,607,757 | 7,267,417 |
| 7,290,852 | 7,517,036 | 7,557,941 | 7,832,842 | 7,549,718 | 7,281,777 |
| 7,631,190 | 7,484,831 | 7,266,661 | 7757,086 | 7,243,193 | 7,866,778 |

BACKGROUND OF INVENTION

Manufacturing a printhead that has relatively high resolution and print-speed raises a number of issues.

One of these relates to the provision of drive and control signals to nozzles. One way to do this is to have a CMOS layer in the same substrate as the print nozzles are constructed. This integration saves space and enables relatively short links between drive circuitry and nozzle actuators.

In a typical layout, such as that disclosed by applicant in a number of the cross-referenced applications, each color in a printhead includes an odd and an even row, which are offset across the pagewidth by half the horizontal nozzle pitch. Each nozzle and its drive circuit are arranged, in plan, in a line parallel to the direction of print media travel relative to the printhead. Moreover, all the nozzle/circuitry pairs in printhead are orientated in the same way. Using odd and even rows offset by half the horizontal nozzle pitch allows dots to be printed more closely together across the page than would be possible if the nozzles and associated drive circuitry had to be positioned side by side in a single row. Dot data to the appropriate row needs to be delayed such that data printed by the two rows ends up aligned correctly on the page.

That said, the relative difference in space requirement for the CMOS and nozzles means there is still some wasted area in the printhead. Also, in designs where high-voltage circuitry is disposed adjacent low-voltage circuitry from another row, careful design and spacing is required to avoid interference between the two.

It would be desirable to improve space usage in a printhead circuit having multiple rows of print nozzles, or at least to provide a useful alternative to prior art arrangements.

SUMMARY OF INVENTION

According to an aspect of the present invention there is provided a printhead comprising:

at least first and second rows of nozzle cells, each nozzle cell having an ink chamber, control circuitry and drive circuitry, each nozzle cell in the first row having a corresponding nozzle cell in the second row, wherein the drive circuitry of each nozzle cell of the first row is arranged: adjacent the drive circuitry of the corresponding nozzle cell in the second row and distant the control circuitry of the corresponding nozzle cell in the first row.

BRIEF DESCRIPTION OF DRAWINGS

A preferred embodiment of the invention will now be described, by way of example only, with reference to the accompanying drawings, in which.

DETAILED DESCRIPTION OF PREFERRED EMBODIMENT

Figure 1:
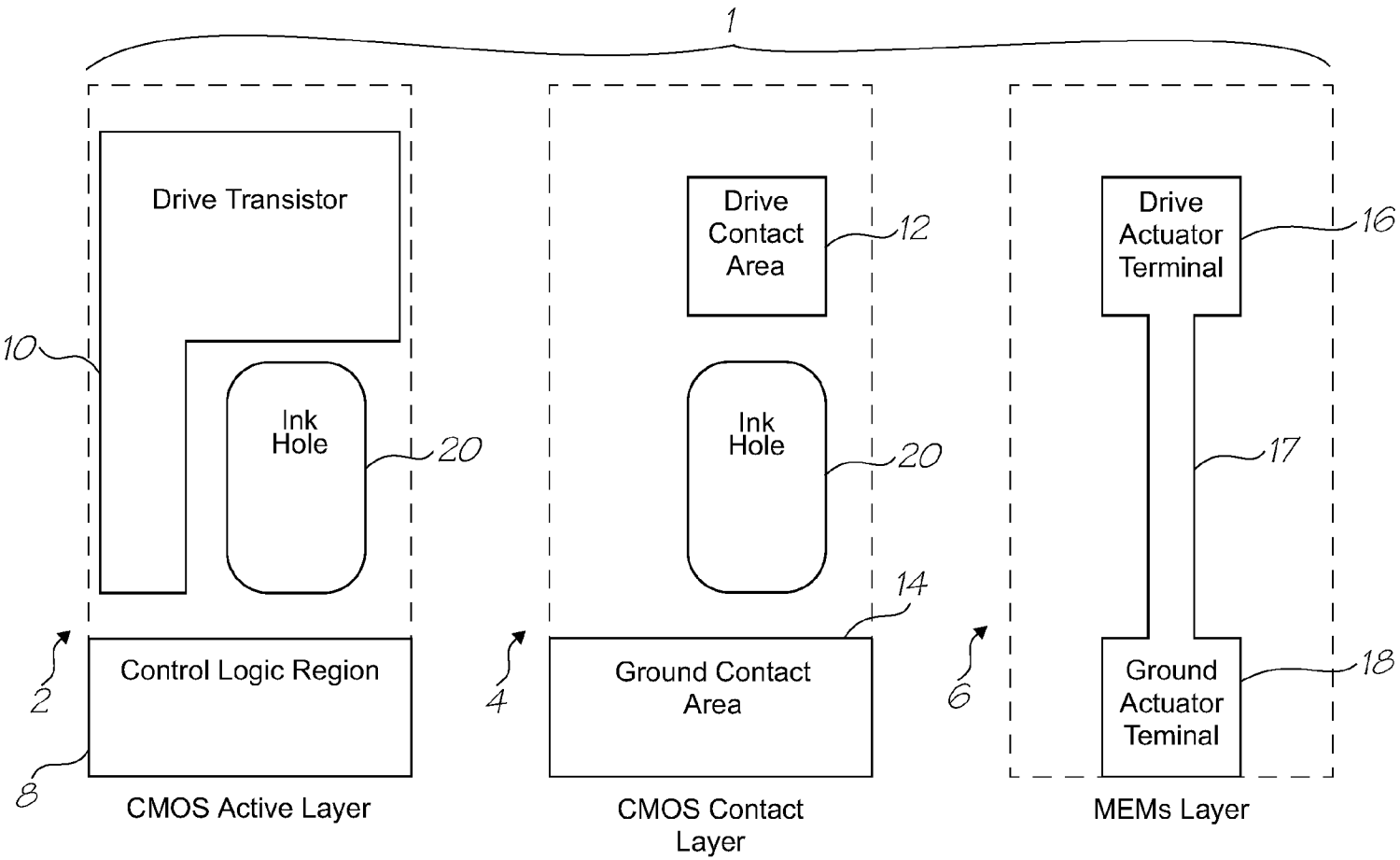
FIG. 1 shows schematics of three separate layers that comprise a unit cell (ie, a nozzle) of a printhead.

Referring to the drawings, FIG. 1 shows the three layers 2, 4, 6 that together make up a unit cell 1 (ie, a nozzle) 1 for a Memjet™ MEMS printhead. Whilst FIG. 1 shows three separate layers in plan, it will be appreciated that, in use, the unit cell is manufactured such that the layers are stacked on top of each other, as shown in side elevation in FIG. 2. It will also be understood that each of the layers 2, 4, 6 is made up of further sublayers and subcomponents, the details of which are omitted for clarity.

The lowest layer 2 contains active CMOS circuits, and is divided into two main regions. The first region contains low voltage CMOS logic circuits 8 that control whether and when the cell 1 ejects ink. The second region contains high voltage CMOS, comprising a large drive transistor 10 that provides the electric current to an actuator (see FIG. 2) that ejects the ink when enabled by the control logic.

The intermediate layer 4 is made up of CMOS metal layer structures that provide contacts to the MEMs layer 6. The drive transistor 10 connects to a drive contact area 12. A ground contact area 14 provides a return path for the current and lies physically above the control logic region 8.

Figure 2:
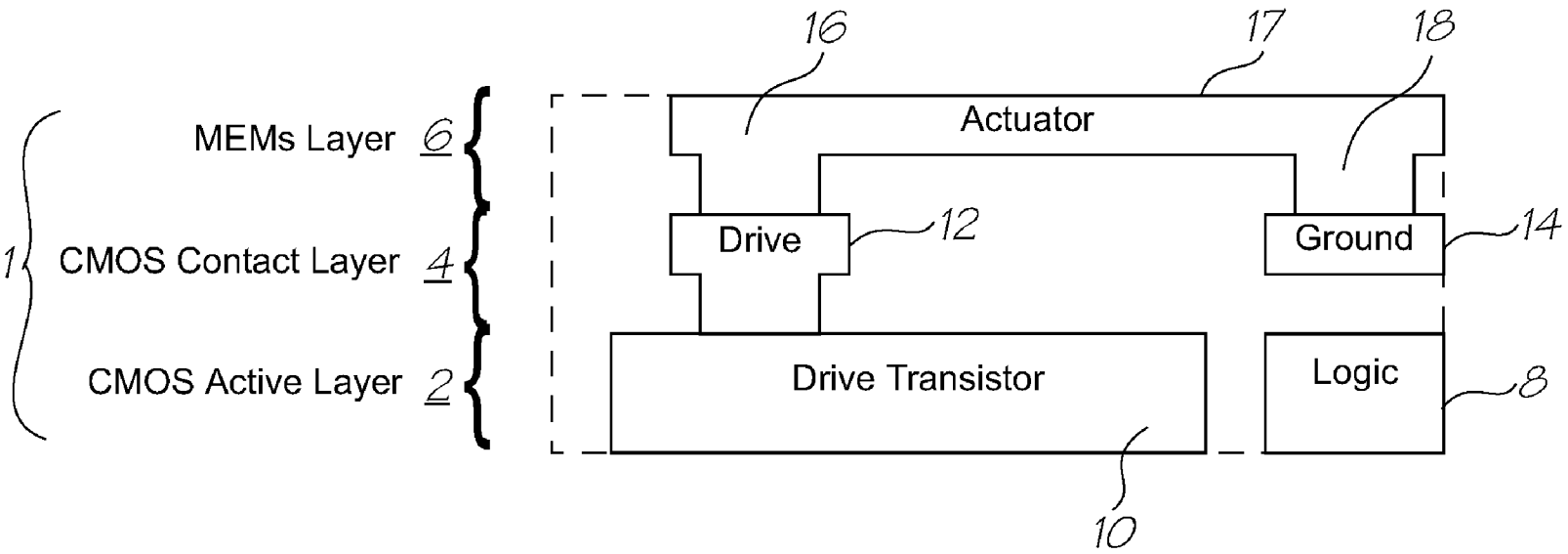
FIG. 2 shows a vertical elevation of the three layers of FIG. 1, in their operative relative positions.

The upper layer 6 is a MEMs layer that includes a MEMs actuator 17. The actuator 17 is connected at one end 16 to the drive transistor 10 through contact area 12, and at the other end 18 to ground contact area 14. The connection through the various layers is best shown in FIG. 2. It will also be noted from FIG. 1 that an ink hole 20 extends through the first and second layers 2, 4 to supply ink to the third layer 6 for expulsion by the actuator.

Figure 3:
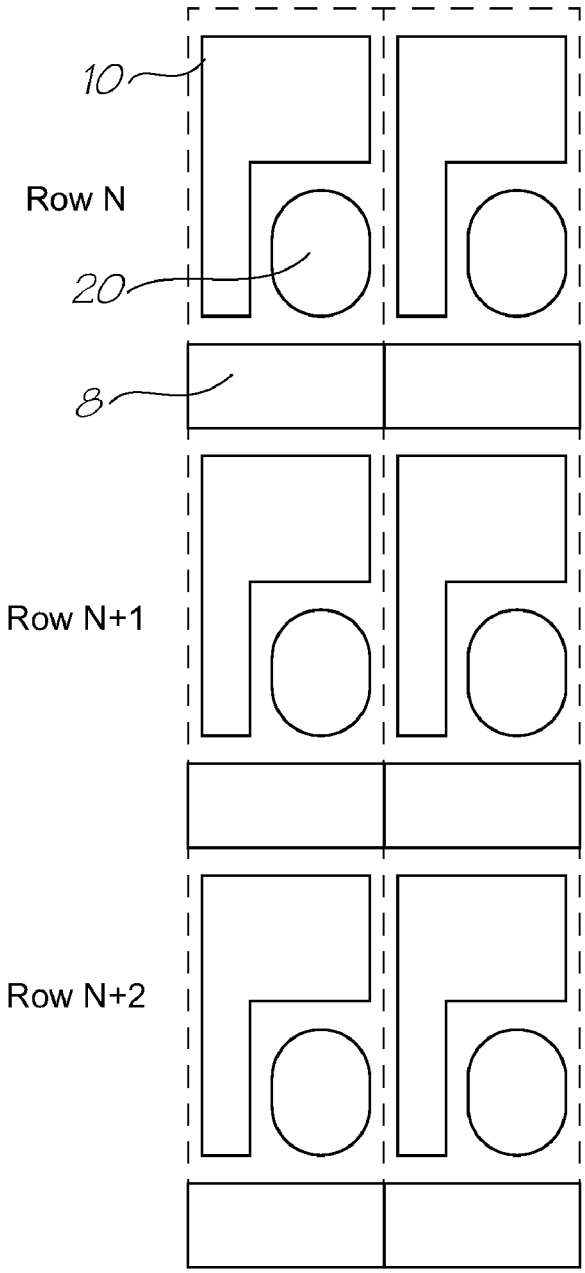
(Prior Art) FIG. 3
FIG. 3 shows a known layout of columns and rows of the unit cells of FIGS. 1 and 2.

As shown in FIG. 3, when unit cells (ie, nozzles) 1 are arrayed in rows and columns to form a complete prior art printhead, various constraints apply to abutting cells.

For clarity, only the CMOS active layer is shown but the position and orientation of the others layers will be clear to one skilled in the art based on the nozzle layout shown in FIG. 1

The control logic circuits 8 of horizontally adjacent rows of nozzles 1 generally abut directly, and global control signals are routed through this area so that they are provided to each cell. Similarly, the ground contact areas (not shown) of horizontally adjacent cells form a continuous metal strip.

Figure 4:
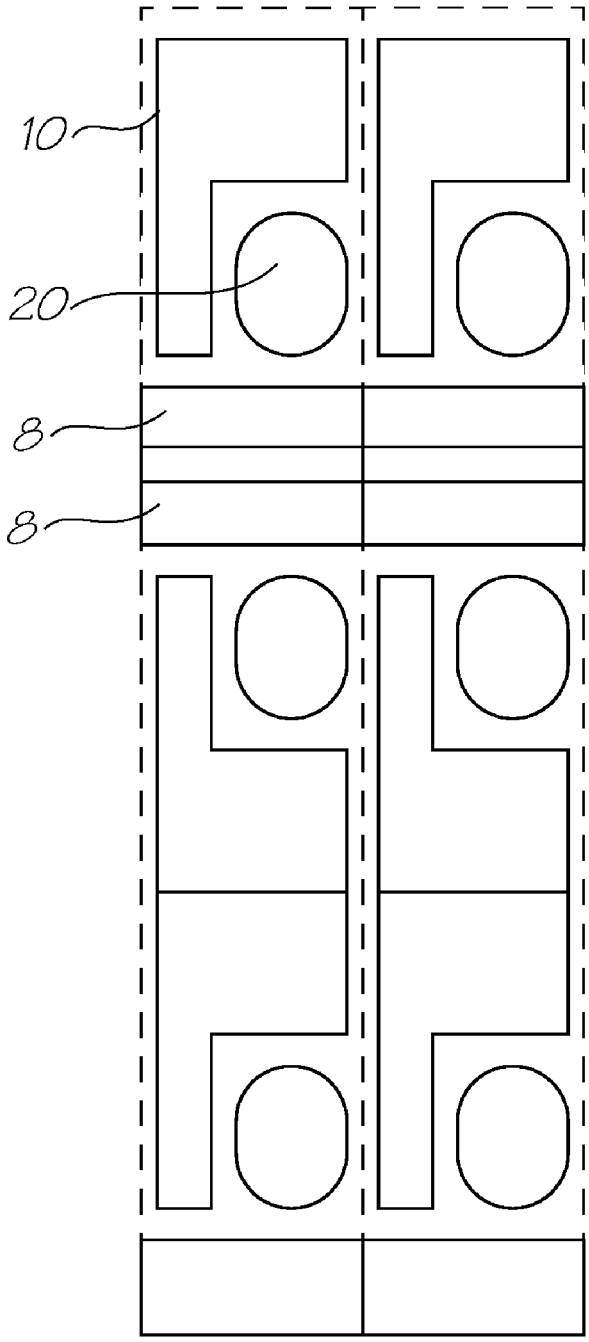
FIG. 4 shows a layout of columns and rows of the unit cells of FIGS. 1 and 2, in accordance with the invention.

The vertical spacing of the rows is determined by the spacing constraints that apply to each layer. In the CMOS active layer, the critical spacing is between the high voltage area of one cell, and the low voltage area of the cell in the adjacent row. In the CMOS contact layer, the critical spacing is between the drive contact of one cell, and the ground contact of the cell in the adjacent row. In the MEMs layer, the critical spacing is between the drive terminal of one actuator, and the ground contact of the actuator in the adjacent row FIG. 4 shows the preferred embodiment of arranging cells into rows in an array, in which every second row is flipped or mirrored. Reference numerals used in this Figure correspond with the features described earlier for those numerals.

In a mirrored arrangement of FIG. 4, the relationship between high and low voltage regions allows a smaller overall vertical row pitch for given unit cell component sizes. In the CMOS active layer shown, pairs of rows have abutting control logic regions 8. This allows global signals to be routed through the array once every row pair, rather than once every row. Additionally, each high voltage region directly abuts only other high voltage regions, halving the number of high-voltage to low-voltage separations in the array.

In the CMOS contact layer (not shown, but refer to FIG. 1), pairs of rows can share a common ground contact area. As cells in adjacent rows are never fired simultaneously in the preferred embodiment, this shared ground contact need only be large enough to carry the current for a single row. Similarly, the ground terminals of the actuators on the MEMs layer (see FIG. 1) can be shared, reducing the size requirement. Although not shown in this embodiment, current can also be supplied to the drive circuits by way of a supply current conduit shared by adjacent rows.

Whilst the preferred embodiment that has been described shows that alternate rows of nozzles are rotated 180 degrees relative to each other, it will be appreciated that they can also be mirror images of each other. Moreover, the rotation or mirroring need not involve a complete 180 degree rotational offset. Much of the advantage of the invention can be achieved with lesser angles of relative rotation. Also, although the preferred embodiment shows devices that are identical in plan, it will be appreciated that the devices in the rows need not be identical. It need merely be the case that the requirement of at least some of the circuitry of nozzles in adjacent rows is asymmetric, such that space and/or design improvements can be taken advantage of by flipping, mirroring or otherwise rotating the nozzle layouts in adjacent rows.

In general, the present invention offers a smaller array size than existing layouts, without affecting the CMOS and MEMs component sizes.

The invention claimed is:

1. A printhead comprising:

at least first and second rows of nozzle cells, each nozzle cell having an ink chamber, control circuitry and drive circuitry, each nozzle cell in the first row having a corresponding nozzle cell in the second row, wherein the drive circuitry of each nozzle cell of the first row is arranged: adjacent the drive circuitry of the corresponding nozzle cell in the second row and distant the control circuitry of the corresponding nozzle cell in the first row, and further wherein the first and second rows of nozzle cells at least partially interlock.

2. A printhead according to claim 1, wherein the drive circuitry of each nozzle cell of the first row at least partially interlocks with the drive circuitry of at least one adjacent nozzle cell of the second row.

3. A printhead according to claim 1, including a plurality of first rows and second rows, each of the first rows being paired with one of the second rows.

4. A printhead according to claim 1, wherein the nozzle cells of the first and second rows are configured to print the same color.

5. A printhead according to claim 4, wherein the nozzle cells of the first and second 25 rows are coupled to the same ink supply.

6. A printhead according to claim 1, wherein the first and second rows are configured to share at least one power supply node.

7. A printhead according to claim 6, wherein the power supply node is an earth node.

8. A printhead according to claim 7, wherein the earth node is rated to conduct current on the basis that only one of the first and second rows will be conducting current to the earth node at any one time.

9. A printhead according to claim 6, wherein the power supply node is a current supply conduit.

10. A printhead according to claim 9, wherein the current supply conduit is rated to conduct current on the basis that only one of the first and second rows will be sourcing current via the current supply conduit at any one time.

11. A printhead according to claim 1, wherein the first and second rows are configured to share at least one global signal.

12. A printhead according to claim 11, wherein the global signal is a fire signal.

13. A printhead according to claim 11, wherein the global signal is a clock signal.

* * * * *